US006522088B2

(12) United States Patent
Delia

(10) Patent No.: US 6,522,088 B2
(45) Date of Patent: Feb. 18, 2003

(54) LAMP IGNITION WITH AUTOMATIC COMPENSATION FOR PARASITIC CAPACITANCE

(75) Inventor: Vincent James Delia, Chicago, IL (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 09/821,175

(22) Filed: Mar. 29, 2001

(65) Prior Publication Data

US 2002/0070683 A1 Jun. 13, 2002

Related U.S. Application Data

(60) Provisional application No. 60/201,547, filed on May 3, 2000.

(51) Int. Cl.[7] ..... G05F 1/00

(52) U.S. Cl. ..... 315/307; 315/289; 315/291; 315/209 CD; 315/276; 315/284; 315/DIG. 5

(58) Field of Search ..... 315/289, 290, 315/209 R, 209 CD, 209 M, 240, 244, DIG. 5, 291, 307, 276, 284, 282

(56) References Cited

U.S. PATENT DOCUMENTS 4,275,337 A * 6/1981 Knoble et al. ..... 315/239
5,013,977 A * 5/1991 Droho ..... 315/209 CD
5,166,581 A * 11/1992 Chermin et al. ..... 315/289
5,319,286 A * 6/1994 Leyten ..... 315/224
5,635,800 A * 6/1997 Taubert ..... 315/171
5,825,139 A 10/1998 Nuckolls et al. ..... 315/307
5,841,245 A * 11/1998 Blom et al. ..... 315/276
6,144,171 A 11/2000 Clements et al. ..... 315/289

* cited by examiner

*Primary Examiner*—Haissa Philogene

(57) ABSTRACT

Ballast circuitry is provided for powering a gaseous discharge lamp which has a range of possible parasitic loading capacitances associated with it. The circuitry includes a reactive source of ignition pulses which stores sufficient energy to charge the highest value of parasitic loading capacitance in the range to at least the minimum ignition voltage of the lamp. A voltage clamping element limits the peak voltage of the ignition pulses, even at the lowest value of parasitic loading capacitance in the range, to a maximum permissible voltage that may be applied to the lamp. The reactive source and the voltage clamping element cooperate to automatically provide high-energy ignition pulses to the lamp, with peak voltages well within permissible limits, over the entire range of parasitic loading capacitances.

19 Claims, 5 Drawing Sheets

LAMP IGNITION WITH AUTOMATIC COMPENSATION FOR PARASITIC CAPACITANCE

This application claims the benefit of U.S. Provisional Application No. 60/201,547, filed May 3, 2000.

BACKGROUND OF THE INVENTION

1. Field of the Invention

This invention relates to gaseous discharge lamps which ignite at voltages that are much higher than their operating voltages and, in particular, to the igniting of such lamps.

2. Description of Related Art

Common characteristics of a gaseous discharge lamp are its negative resistance and high igniting voltage. Circuitry for powering such a lamp typically includes a current limiting means, such as a ballast, to compensate for the negative resistance, and often includes igniter circuitry for generating high-voltage pulses to ignite the lamps. Such igniter circuitry commonly includes a voltage-sensitive switch (e.g. a sidac) for effecting the continual production of the high-voltage pulses until the lamp ignites. Upon ignition, the voltage across the lamp decreases from a higher open-circuit voltage (OCV) to a lower voltage, which causes the switch to change to a non-conducting state and to effect termination of pulse production. One example of such a ballast is described in U.S. Pat. No. 5,825,139.

Igniter circuitry must be capable of starting gaseous discharge lamps despite the loading effect of parasitic capacitances associated with the lamp. Such parasitic capacitances are typically found in the wiring and fixtures via which the circuitry is electrically connected to the lamp and even in the lamp itself. Designing igniter circuitry which effectively compensates for such parasitic capacitances is difficult, because it varies significantly with, for example, the length of wiring that is used to electrically connect the igniter/ballast circuitry to the lamp. Without any compensation, the peak voltage delivered to the lamp would tend to decrease with increases in parasitic capacitance.

SUMMARY OF THE INVENTION

It is an object of the invention to provide circuitry for igniting a gaseous discharge lamp which automatically compensates for the affect of parasitic loading capacitances associated with the lamp.

It is another object of the invention to provide such compensation without substantially increasing the cost or complexity of the circuitry.

In accordance with the invention, circuitry is provided for powering a gaseous discharge lamp having a range of possible values of parasitic loading capacitance associated with it, which range extends from a lower capacitance value to a higher capacitance value. The circuitry includes a source of ignition pulses including an energy source capable of effecting charging of the parasitic loading capacitance of the higher value to at least a minimum ignition voltage of the lamp. A voltage clamping device is provided for limiting the peak voltage of the ignition pulses delivered to the lamp at the lower parasitic capacitance value to a maximum permissible voltage.

Collectively, the energy source and the voltage clamping device are capable of maintaining the peak ignition pulse voltage at a substantially constant value over a predetermined range of parasitic loading capacitance values. As another advantage, at all but the highest values of parasitic loading capacitance within the range, the ignition pulses tend to be of longer duration (and thus have increased energy levels), in comparison with known circuitry.

DESCRIPTION OF THE PREFERRED EMBODIMENT(S)

Figure 1:
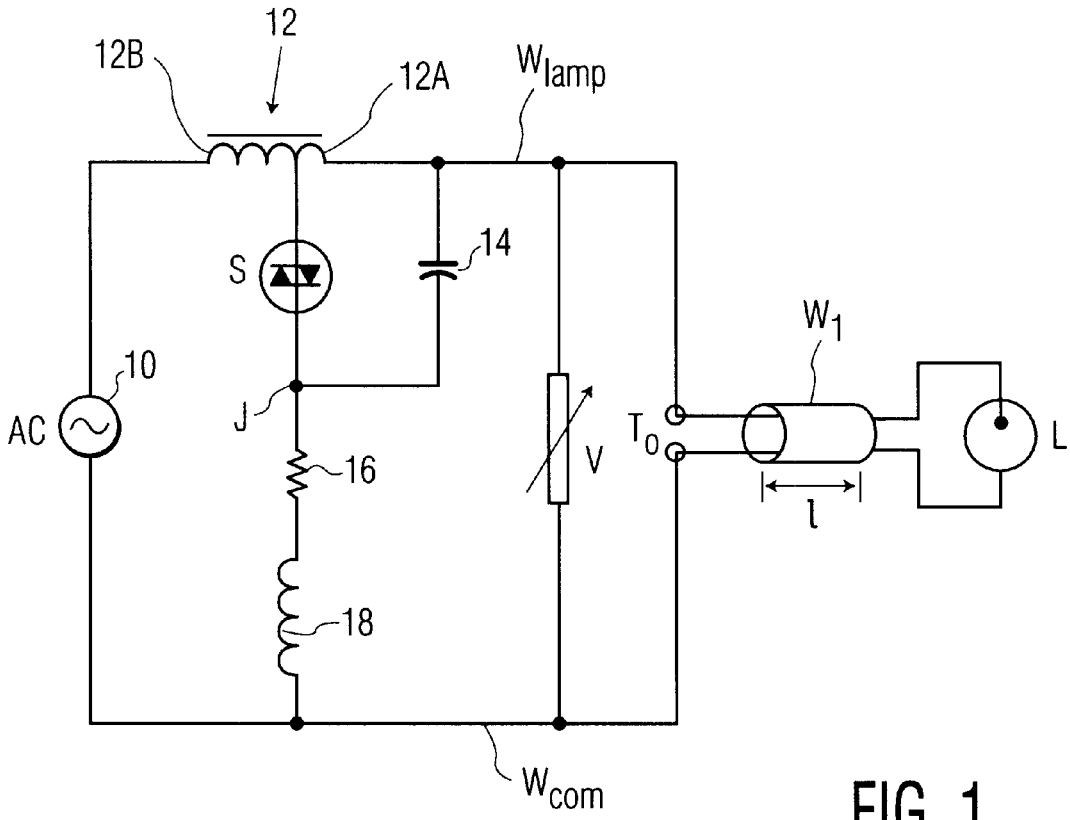
FIG. 1 is a schematic drawing of a circuit arrangement in accordance with a first embodiment of the invention.

FIG. 1 illustrates an exemplary embodiment of an electromagnetic ballast which incorporates the invention. This ballast includes an AC source 10 and an autotransformer 12 electrically connected in a first series loop with a gaseous discharge lamp L via a lamp supply conductor $W_{lamp}$, a common conductor $W_{com}$, and a length of two-conductor cable $W_t$, extending from output terminals $T_o$ of the ballast to the lamp L. The autotransformer is formed from a ballast inductor having a primary winding 12A and a secondary winding 12B. A bi-directional voltage-sensitive switch S is electrically connected in a second series loop with a capacitor 14 and the primary winding 12A. In this embodiment the switch S is a sidac. A resistor 16 and an RF blocking coil 18 are electrically connected in series between a junction J (connecting-one side of the sidac S and the capacitor 14) and the common conductor $W_{com}$. A varistor V is electrically connected between the lamp supply conductor $W_{lamp}$ and the common conductor $W_{com}$. The function of this varistor is explained following a general description of the operation of the circuitry of FIG. 1.

In operation, during each positive cycle of the AC voltage produced by the source 10, capacitor 14 charges through the path including the autotransformer 12, the resistor 16 and the coil 18. If the lamp has not yet ignited, capacitor 14 charges until its voltage exceeds the breakover threshold of the sidac S. When the sidac breaks over, the voltage on the capacitor is applied across primary winding 12A, resulting in the production of a stepped-up voltage across secondary winding 12B and causing a high-voltage ignition pulse to be produced at the output terminals $T_o$. This pulse is applied to the lamp L via the cable $W_t$.

When the current through the sidac S approaches zero, the sidac switches off and the capacitor voltage follows that of the AC source until it again exceeds the breakover voltage of the sidac. The resistor 16 forms a timing circuit with capacitor 14. The RC time constant of this circuit determines a phase shift in the charging voltage of the capacitor, relative to the phase of the voltage produced by the AC source 10. Advantageously, this time constant is made such that the breakover voltage occurs near the peak voltage produced by the AC source and such that at least one ignition pulse is produced per half cycle.

During each negative half cycle, the circuit of FIG. 1 operates in the same manner, but with the current flowing in the opposite direction to produce a high-voltage ignition pulse. The circuit continues to produce ignition pulses until the lamp goes into conduction. When that occurs, the lamp voltage decreases rapidly and stabilizes at a voltage which is too low to permit capacitor 14 to again charge to the breakover voltage of the sidac S. Then the ignition pulses cease and the lamp is maintained in conduction by the operation of the AC source 10 and the autotransformer 12.

The peak voltage of the ignition pulses is determined, to a large degree, by the energy-storage capacities of the autotransformer 12 and the capacitor 14 relative to the value of the parasitic loading capacitance associated with the lamp L. In effect, the autotransformer 12 and the capacitor 14 serve as reactive sources of energy for charging the parasitic capacitance. As the value of parasitic capacitance increases, so does the amount of energy needed to charge it to the voltage needed to ignite the lamp. The reactive storage capacity of the circuitry can be increased (e.g. by increasing the value of capacitor 14) to compensate for the loading of the parasitic capacitance, but this approach is effective only if the parasitic capacitance is known and does not change.

In accordance with the embodiment of the invention shown in FIG. 1, automatic compensation for a range of parasitic capacitance values is achieved by the cooperation of the varistor V, the autotransformer, and the capacitor 14. These components cooperate to automatically regulate the peak pulse voltage that is delivered to the lamp L over a chosen range of values of parasitic loading capacitance associated with the lamp. The peak pulse voltage actually delivered to the lamp, at any value of loading capacitance within this range, should be at least equal to the minimum voltage needed to ignite the lamp but no greater than the maximum permissible ignition voltage that may be applied to the lamp. These voltages are determined from manufacturers specifications for the specific type or types of lamps for which the circuitry is designed.

Figure 2:
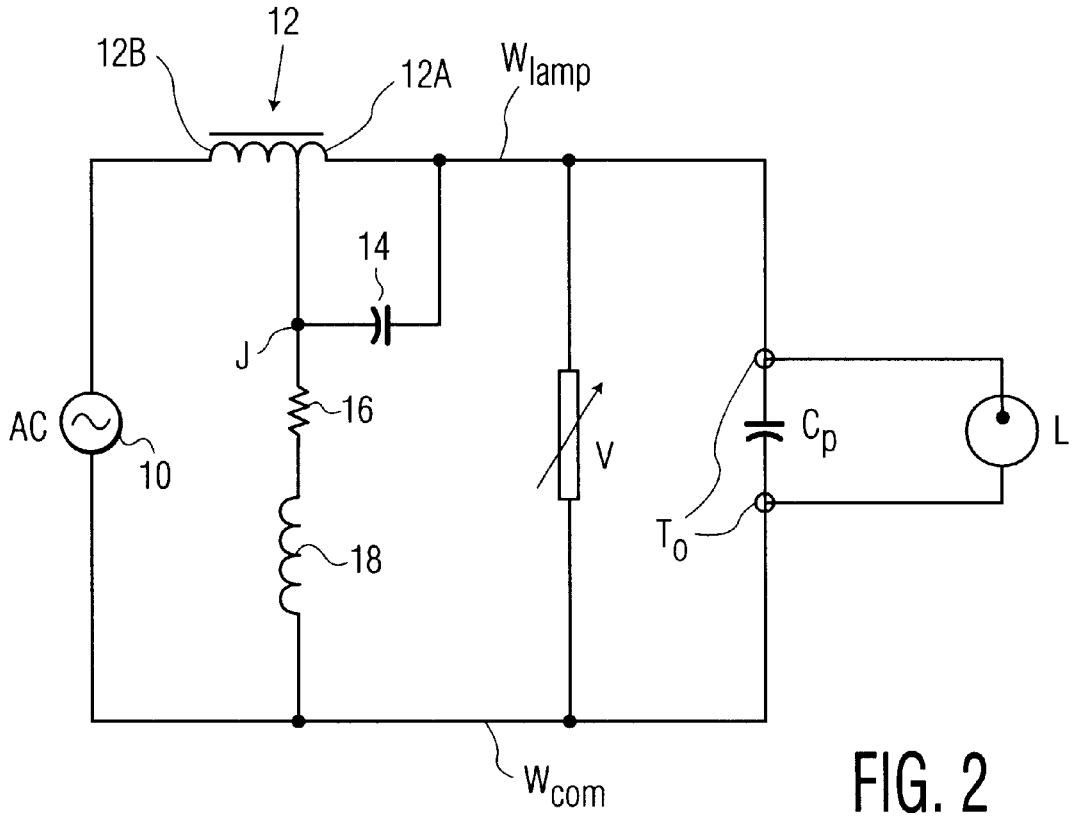
FIG. 2 is an equivalent circuit for the arrangement of FIG. 1 at an instant in time.
Figure 3A:
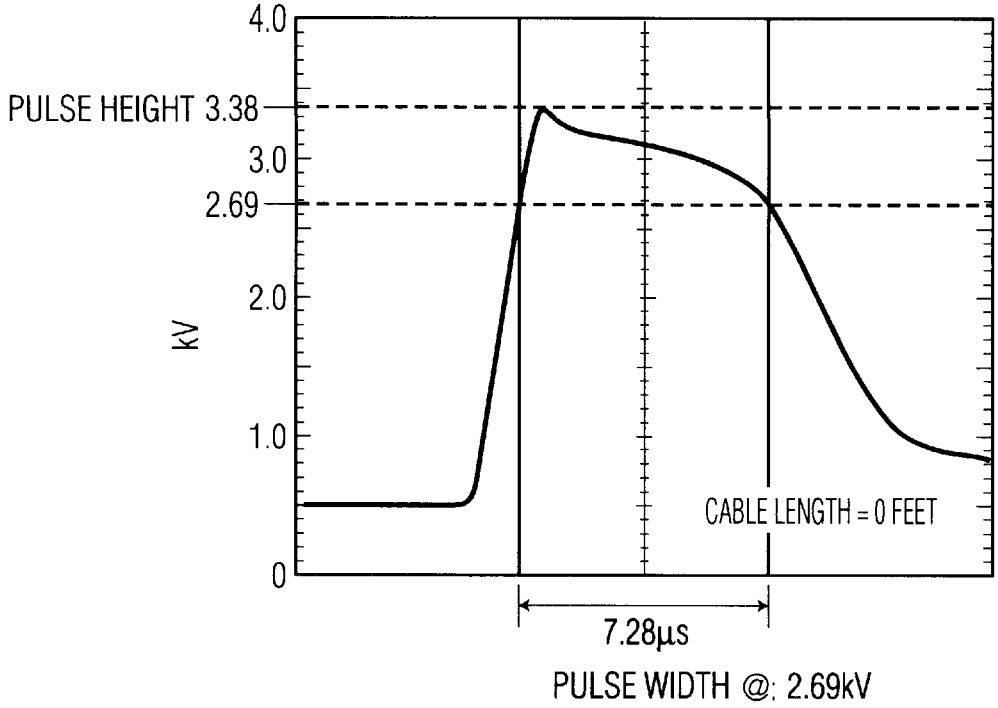
FIGS. 3*a* through 3*f* are illustrations of ignition pulses produced by the embodiment of FIG. 1.
Figure 3B:
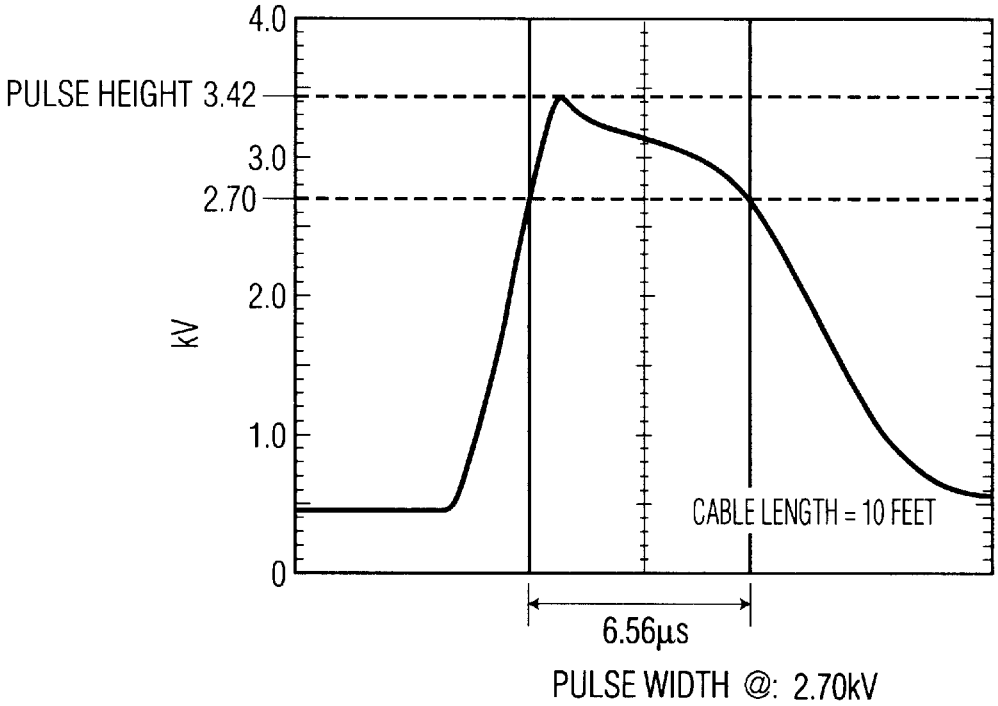
Figure 3C:
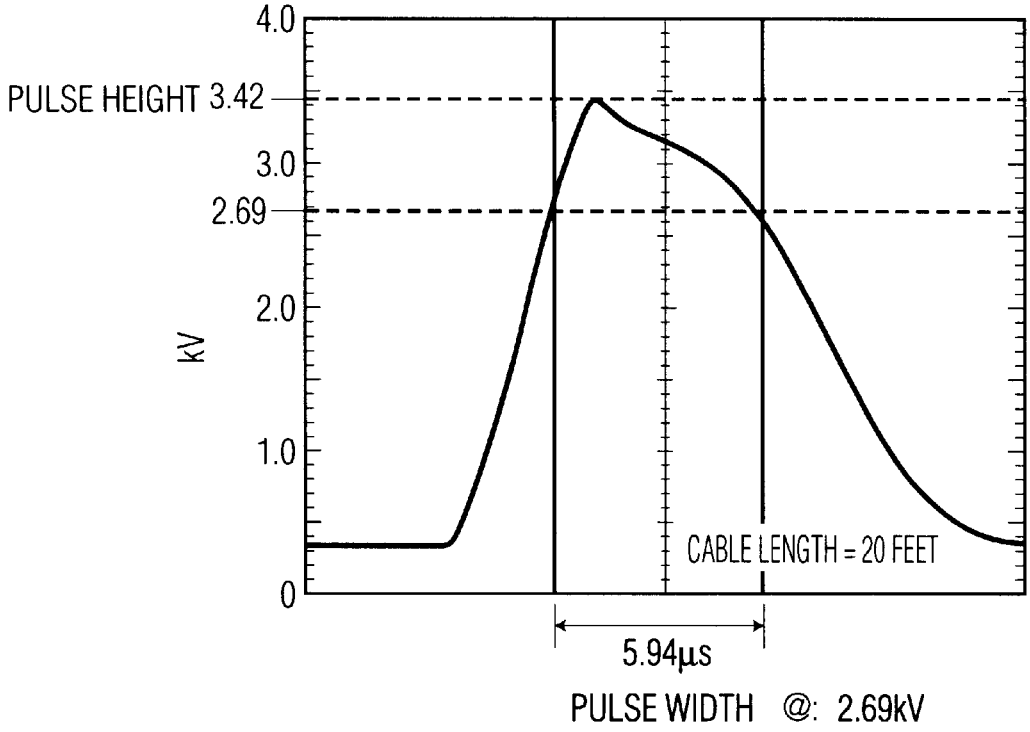
Figure 3D:
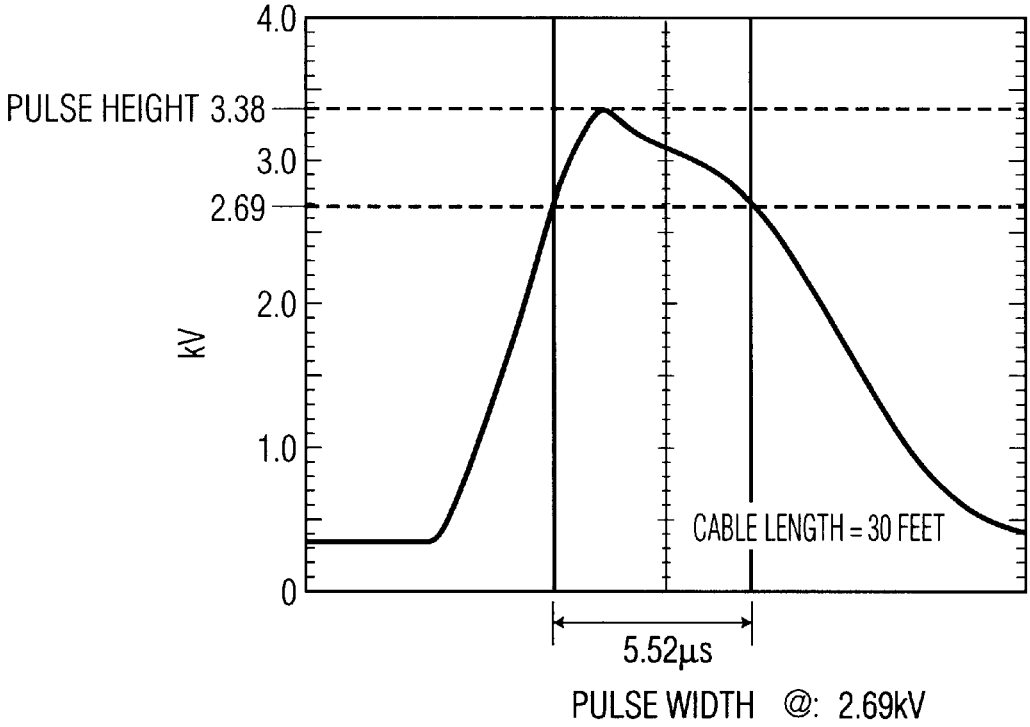
Figure 3E:
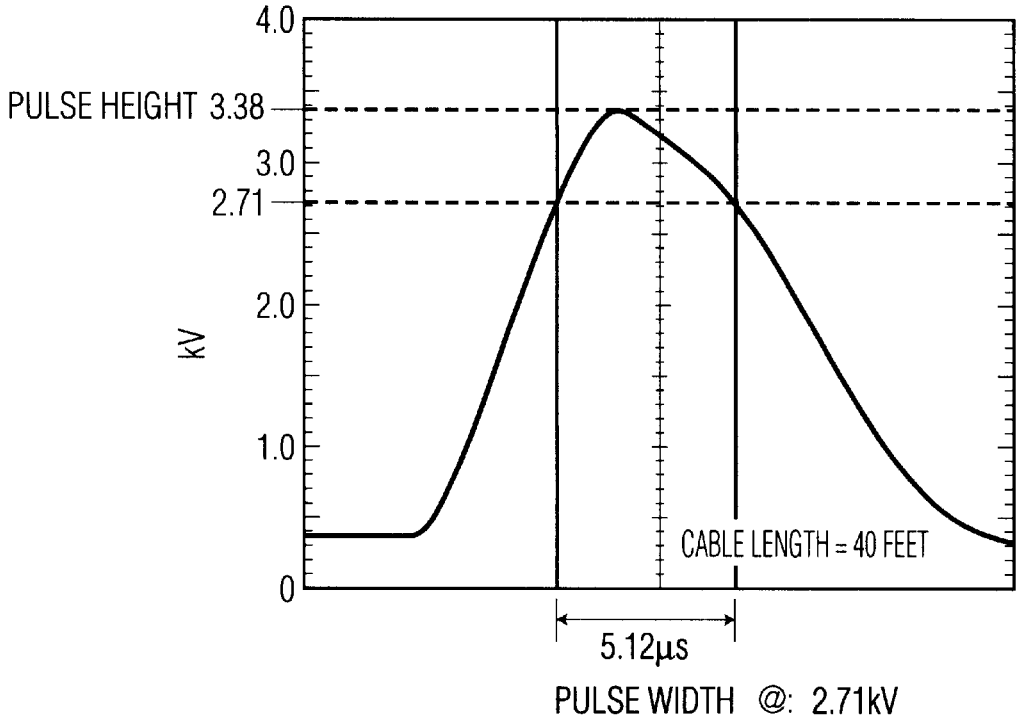
Figure 3F:
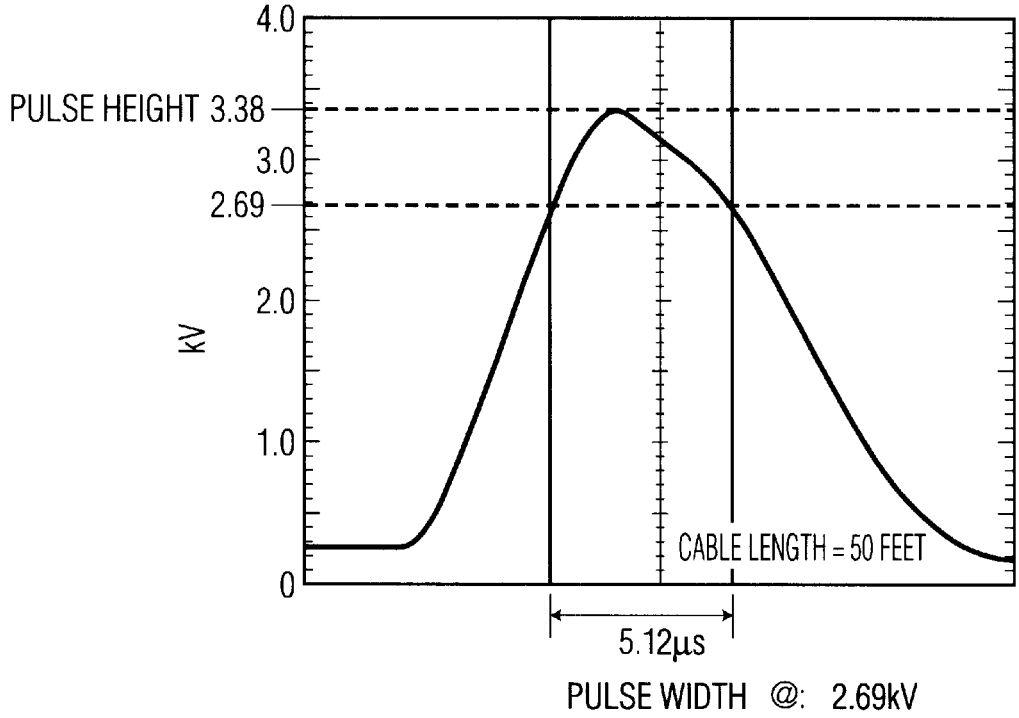

In order to understand the cooperation of the varistor V and the capacitor 14, it is helpful to refer to FIG. 2, which represents an equivalent of the circuit shown in FIG. 1 immediately after breakover of the sidac S. In this equivalent circuit, the conducting sidac is replaced with a conductor and the combined parasitic capacitances associated with the lamp (e.g. those of the cable, the lamp L and a fixture for the lamp) are represented by a capacitor $C_p$.

At the instant following breakover of the sidac:

The voltage on capacitor 14 is imposed across the primary winding 12A and stepped up to a higher voltage appearing across the secondary winding 12B.

The voltages across the primary and secondary windings add to the instantaneous voltage then being produced by the source 10 to apply the peak ignition pulse voltage across the conductors $W_{lamp}$ and $W_{com}$.

Capacitor 14 predominately becomes the effective source of energy for charging all parasitic capacitance along the path from the output terminals $T_o$ of the ballast to the lamp L, i.e. for charging the capacitance $C_p$.

The lamp L has not yet ignited and thus can be considered as an open circuit.

The value of the capacitor 14 is made large enough to effect charging of the largest parasitic loading capacitance in the range to a voltage that is greater than the minimum voltage required to ignite the lamp. At lower values of parasitic capacitance within this range, the value of capacitor 14 would be too large. That is, it would effect charging of lower values of parasitic capacitance to ignition voltages that are higher than desired (e.g. higher than a maximum permissible ignition voltage for the lamp). However, this is prevented by the varistor V, which operates similarly to a Zener diode but is capable of clamping very high voltages (e.g. voltages on the order of several thousand volts). As long as the voltage applied across the varistor is below its rated operating voltage, it has a very high impedance. The specific varistor is selected to have a clamping voltage that is higher than the desired ignition voltage, but lower than the maximum-permissible ignition voltage.

For example, a specific circuit of the type shown in FIG. 1 was designed to ignite and power a metal halide lamp requiring a minimum ignition voltage of 3 kV, but having a maximum allowable ignition voltage of 4 kV, over a cable $W_l$ which was the main source of loading parasitic capacitance. The cable would have a length l ranging from 0 to 50 feet, depending on the installation of the lamp. The corresponding parasitic capacitance of the cable ranged from 0 to about 1500 pf. Using the circuit components listed in Table I, the circuit arrangement produced the ignition pulses shown in FIGS. 3*a* through 3*f* for cable lengths of 0 through 50 feet. Over this entire range, the peak ignition pulse voltage remained within the range of approximately 3.37 kV to 3.46 kV. Note that, if the varistor would be removed from the circuit, the peak pulse voltages delivered to the lamp would range from about 6 kV (for a 0 foot cable) to about 3.4 kV (for a 50 foot cable). Note further that the ignition pulses tend to be of longer duration (and to have increased energy levels) as the parasitic loading capacitance (cable length) decreases, in comparison with known circuitry. At the longer cable lengths the energy levels (represented by the areas under the pulse waveforms) tends to be about the same as for comparable prior art circuitry. At all other cable lengths, the energy levels tend to be higher, thus providing increased starting power.

TABLE I

Exemplary Components for FIG. 1 Circuit

| Ref # | Description |
|---|---|
| 10 | 277 VRMS source |
| 12 | tapped autotransformer with N turns |
| 12A | 0.1 N turns of primary winding |
| 12B | 0.9 N turns of secondary winding |
| S | 230 V sidac |
| 14 | 0.458 $\mu$F capacitor |
| 16 | 4k Ohm, 18 Watt resistor |
| 18 | 45 mH choke |
| $W_1$ | three-conductor, 16 AWG insulated copper cable |
| V | series-connected EPCOS disk varistors types S14K1000 and S14K320 (combined max clamping voltage = 3810 V @ 50 A) |

Figure 4:
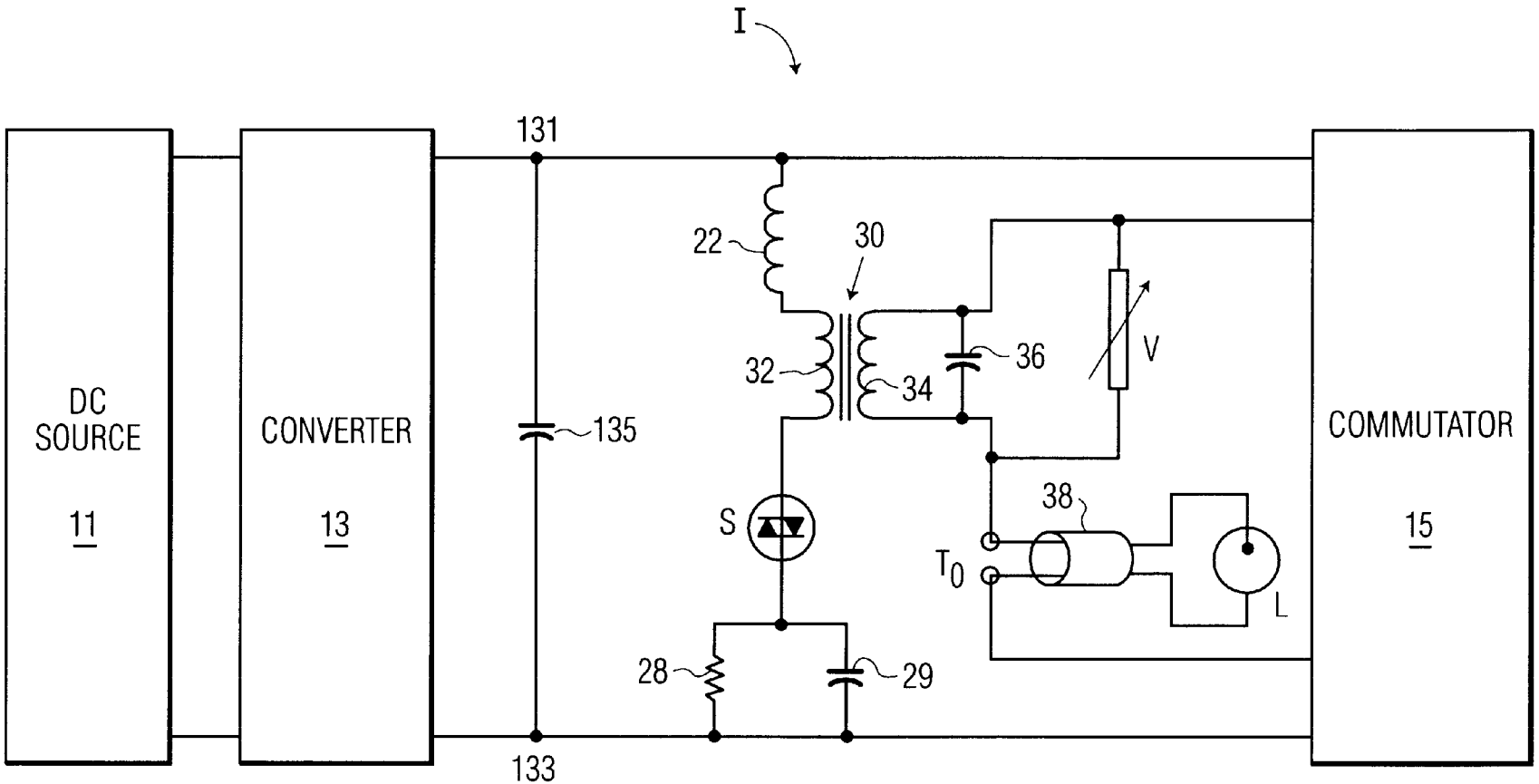
FIG. 4 is a schematic drawing of a circuit arrangement in accordance with a second embodiment of the invention.

FIG. 4 illustrates an exemplary embodiment of an electronic ballast which incorporates the invention. This ballast includes a source of DC power 11, a converter 13 having output terminals 131 and 133 between which an output capacitor 135 is connected, a commutator 15, and igniter circuitry I. The converter in this exemplary embodiment is a down converter which serves as a current source and applies to the commutator 15 and to the igniter circuitry I a voltage which is lower than that supplied by the DC source 11. The commutator 15 is provided for applying a periodically-reversing current, via a secondary winding 34 of a transformer 30, and via an electrical cable 38, to a gaseous discharge lamp L.

The igniter circuitry I includes, in addition to the secondary winding 34, an inductor 22, a primary winding 32, a sidac S, and a parallel combination of a resistor 28 and a capacitor 29, all electrically connected in series between the output terminals 131 and 133 of the converter 13. Preferably, as described in U.S. patent application Ser. No. 09/306,911 filed on now U.S. Pat No. 6,144,171, May 7, 1999, which is hereby incorporated by reference, the transformer is one of a type which does not saturate at full lamp current (e.g. a gapped transformer) and a capacitor 36 is electrically connected across the secondary winding 34. This dampens ripple current delivered by the converter 13.

The inductor 22 protects the sidac by limiting the rate of change of current through it upon breakover. The capacitor 36 compensates .for reduced coupling from the primary winding 32 to the secondary winding 34 when a gapped transformer is used. The capacitor 36 also adjusts the resonance frequency of the secondary circuit of the transformer 30 and shapes the ignition pulses so that the ignition-pulse specification of the lamp L is met throughout the full range of load conditions for which the ballast is intended, including varying load capacitance as affected by length of the cable 38. This capacitor does not, however, compensate for reductions in the peak voltage of the ignition pulses. That is achieved by capacitor 29 working in cooperation with transformer 30 and a varistor V which is electrically connected, via the commutator 15, across output terminals $T_o$ of the ballast.

In operation, after power is applied by the DC source to the converter 13, internal switching circuitry (not shown) of the converter charges the output capacitor 135. The voltage across the sidac S is equal to the voltage across the capacitor 135. When this voltage reaches the breakover voltage of the sidac, the capacitor 135 discharges a current pulse through the primary winding 32, the sidac, and the parallel RC combination 28, 29, and effects production at the secondary winding 34 of a high voltage pulse. The current pulse ends when capacitor 29 charges to a voltage near that on capacitor 135 and, the current through the sidac becomes too low to keep it in conduction. Then the sidac switches OFF (i.e. into a non-conducting state) and capacitor 29 discharges through resistor 28.

If this first high-voltage pulse (transformed to a high-voltage pulse via the transformer 30) has ignited the lamp L, the lamp impedance drops to a low value, discharges the capacitor 135 to a voltage well below the breakover voltage of the sidac S, and the igniter circuitry will become inactive. However, the igniter circuitry will remain on standby and will immediately reactivate if the lamp extinguishes.

If the pulse does not ignite the lamp, the capacitor 29 will discharge through the resistor 28 until the voltage across the sidac again exceeds its breakover voltage and then the pulse-generating sequence will be repeated. The time constant of this RC timing circuit determines the number of ignition-pulses per commutator period.

In the circuitry of FIG. 4, the peak voltage of the ignition pulses is determined primarily by the energy-storage capacities of the transformer 30 and the capacitor 29 relative to the value of the parasitic loading capacitance associated with the lamp L.

It is these reactive components which collectively serve as the energy sources for charging the parasitic capacitance and which cooperate with the varistor V to automatically regulate the peak pulse voltage that is delivered to the lamp L over a chosen range of values of parasitic capacitance.

Although the invention has been explained with reference to two exemplary embodiments, many alternatives embodiments within the scope of the invention are possible. For example, a voltage source can be connected to the primary winding of a transformer to store energy in the transformer. If the current from the voltage source is suddenly interrupted, the transformer itself can serve as the predominate or sole energy source for effecting charging of the parasitic loading capacitance. As another alternative, a resonant circuit employing capacitive and inductive elements could be used as the effective energy source for charging the parasitic loading capacitance. Further, although a varistor was selected from currently available components as the preferred type of voltage clamping device for the specific embodiments disclosed, alternative devices may be used, any type of available clamping device which meets the specific circuit and operational requirements may be used.

What is claimed is:

1. Circuitry for powering a gaseous discharge lamp having a range of possible values of associated parasitic loading capacitance, said range extending from a lower value of capacitance to a higher value of capacitance, said circuitry including:

a. a source of ignition pulses including an energy source capable of effecting charging of the parasitic loading capacitance of the higher value to at least a minimum ignition voltage of the lamp; and b. a voltage clamping element for limiting the peak voltage of the ignition pulses delivered to the lamp at the lower value of parasitic capacitance to a permissible maximum voltage.

2. Circuitry as in claim 1 where the source of ignition pulses comprises a capacitive energy source.

3. Circuitry as in claim 1 where the source of ignition pulses comprises an inductive energy source.

4. Circuitry as in claim 1 where the voltage clamping element comprises a varistor.

5. Circuitry as in claim 1, where the clamping element limits the peak voltage to less than the permissible maximum voltage.

6. Circuitry for powering a gaseous discharge lamp requiring ignition pulses having at least a minimum voltage, but which do not exceed a maximum voltage over a known range of possible parasitic loading capacitances associated with the lamp, said circuitry comprising:

a. a source of ignition pulses including a reactive energy storage means capable of delivering to the lamp pulses of at least the minimum voltage at any value of parasitic loading capacitance within the known range;

b. voltage clamping means for limiting the voltage of the ignition pulses delivered to the lamp to the maximum voltage.

7. Circuitry as in claim 6 where the source of ignition pulses comprises an inductive energy source.

8. Circuitry as in claim 6 where the voltage clamping means comprises a varistor.

9. Circuitry as in claim 6 where the source of ignition pulses comprises a capacitive energy source.

10. Circuitry as in claim 6, where the voltage clamping means limits the peak voltage to less than the permissible maximum voltage.

11. Circuitry for powering a gaseous discharge lamp having a range of possible values of associated parasitic loading capacitance, said range extending from a lower value of capacitance to a higher value of capacitance, said circuitry including:

a. a reactive source of ignition pulses for storing sufficient energy to charge a highest value of parasitic loading capacitance in the range to at least a minimum ignition voltage of the lamp; and b. a voltage clamping element for limiting the peak voltage of the ignition pulses, even at the lowest value of parasitic loading capacitance in the range, to a maximum permissible voltage that may be applied to the lamp.

12. Circuitry as in claim 11 where the voltage clamping element comprises a varistor.

13. Circuitry as in claim 11 where the source of ignition pulses comprises a capacitive energy source.

14. Circuitry as in claim 11 where the source of ignition pulses comprises an inductive energy source.

15. Circuitry as in claim 11 where the clamping element limits the peak voltage to less than the maximum permissible voltage.

16. Apparatus for powering a gaseous discharge lamp having a range of possible values of associated parasitic loading capacitance, said range extending from a lower value of capacitance to a higher value of capacitance, said apparatus including:

a. means for producing ignition pulses capable of effecting charging of the parasitic loading capacitance of the higher value to at least a minimum ignition voltage of the lamp; and;

b. means for limiting the peak voltage of the ignition pulses delivered to the lamp at the lower value of parasitic capacitance to a permissible maximum voltage.

17. Apparatus as in claim 16 where the means for producing ignition pulses comprises a capacitive energy source.

18. Apparatus as in claim 16 where the means for producing ignition pulses comprises an inductive energy source.

19. Apparatus as in claim 16 where the claiming element limits the peak voltage to less than the permissible maximum voltage.

* * * * *